US005291955A

United States Patent [19]

Clark

[11] Patent Number: 5,291,955

[45] Date of Patent: Mar. 8, 1994

[54] HYDRAULIC HAMMER

[76] Inventor: Thomas P. Clark, 1906 Cardinal La., McAlester, Okla. 74501

[21] Appl. No.: 31,674

[22] Filed: Mar. 15, 1993

[51] Int. Cl.[5] ..... B25D 9/00

[52] U.S. Cl. ..... 173/24; 173/82; 173/84; 173/89

[58] Field of Search ..... 173/2, 4, 10, 11, 82, 173/84, 115, 24, 27, 28, 89

[56] References Cited

U.S. PATENT DOCUMENTS

| | | | |
|---|---|---|---|
| 2,672,331 | 3/1954 | Cornett | 262/13 |
| 3,381,764 | 5/1968 | Peterson et al. | 173/115 |
| 3,384,186 | 5/1968 | Broderson et al. | 173/24 |
| 3,805,896 | 4/1974 | Bauer | 173/16 |
| 4,100,977 | 7/1978 | Elliott | 173/134 |
| 4,505,340 | 3/1985 | Yantsen et al. | 173/134 |
| 4,580,640 | 4/1986 | Boldt | 173/10 |
| 4,732,506 | 3/1988 | Bays | 404/90 |
| 4,852,661 | 8/1989 | Ellington | 173/84 |

*Primary Examiner*—Scott Smith

*Attorney, Agent, or Firm*—Catalano, Zingerman & McKay

[57] ABSTRACT

The present invention is a self-contained hydraulic hammer which is mounted on a hydraulically mobile frame. The hydraulic hammer is capable of travelling in either forward or reverse directions and is provided with liftable weights to which a tool for digging or breaking up a surface is attached. The hydraulic hammer is equipped with time delay controls which: 1) momentarily stop the travel of the hydraulic hammer as the weights and the attached digging tool free fall from a raised position until the digging tool impacts the surface to be busted up, and 2) cause the hydraulic hammer to resume travel as the weights are again raised in preparation for another impact. The hydraulic hammer rapidly repeats these cycles of impact and travel to break up a surface. Adjustments are provided on the hydraulic hammer for regulating the force of the impact and the distance travelled between impacts in order to match the hydraulic hammer's impact and travel cycles to the break characteristics of the surface to be removed.

6 Claims, 7 Drawing Sheets

HYDRAULIC HAMMER

BACKGROUND OF THE INVENTION

1. Field of the Invention

The present invention relates to a hydraulic hammer which has time delay controls which coordinate dropping of weights to break up a surface with forward or reverse travel of the hydraulic hammer. The hydraulic hammer is thus controlled so it momentarily stops its travel while the weights drop and then resumes its travel as the weights are again lifted for another drop.

2. Description of the Related Art

Currently, surfaces to be repaired, such as cement slabs and asphalt used in highway construction, must first be busted up by some type of breaking equipment, and then the busted up pieces must be removed by a back-hoe or other similar dirt moving equipment before repair or replacement of the surface can be accomplished. Breaking equipment currently available are large machines which are difficult to transport and cannot be maneuvered in tight locations. Also, none of the currently available breaking equipment automatically coordinate the forward or reverse travel of the machine with the breaking stroke or action of the equipment. The operator must perform this coordination when using existing equipment.

The present invention solves these problems by providing a small mobile hydraulic hammer which can be easily maneuvered at the work site and maneuvered onto a small trailer for transport to other work sites. The operation of the present invention coordinates its horizontal travel along the surface with its breaking action, i.e. dropping of weights, by means of time delay controls.

SUMMARY OF THE INVENTION

Briefly, the present invention is a hydraulic hammer which is capable of automatically synchronizing the lifting of a weight package and attached digging tool with forward or reverse travel of the hydraulic hammer and is also capable of synchronizing the dropping and impact of the weight package and digging tool with stopping of the forward or reverse travel of the hydraulic hammer. Synchronization is accomplished through use of relay and delay timers which serve to electrically control the operation of hydraulic regulating solenoids. The solenoids, in turn, lift or allow the weights to drop and control travel of the hydraulic hammer.

DETAILED DESCRIPTION OF THE PREFERRED EMBODIMENT

Figure 1:
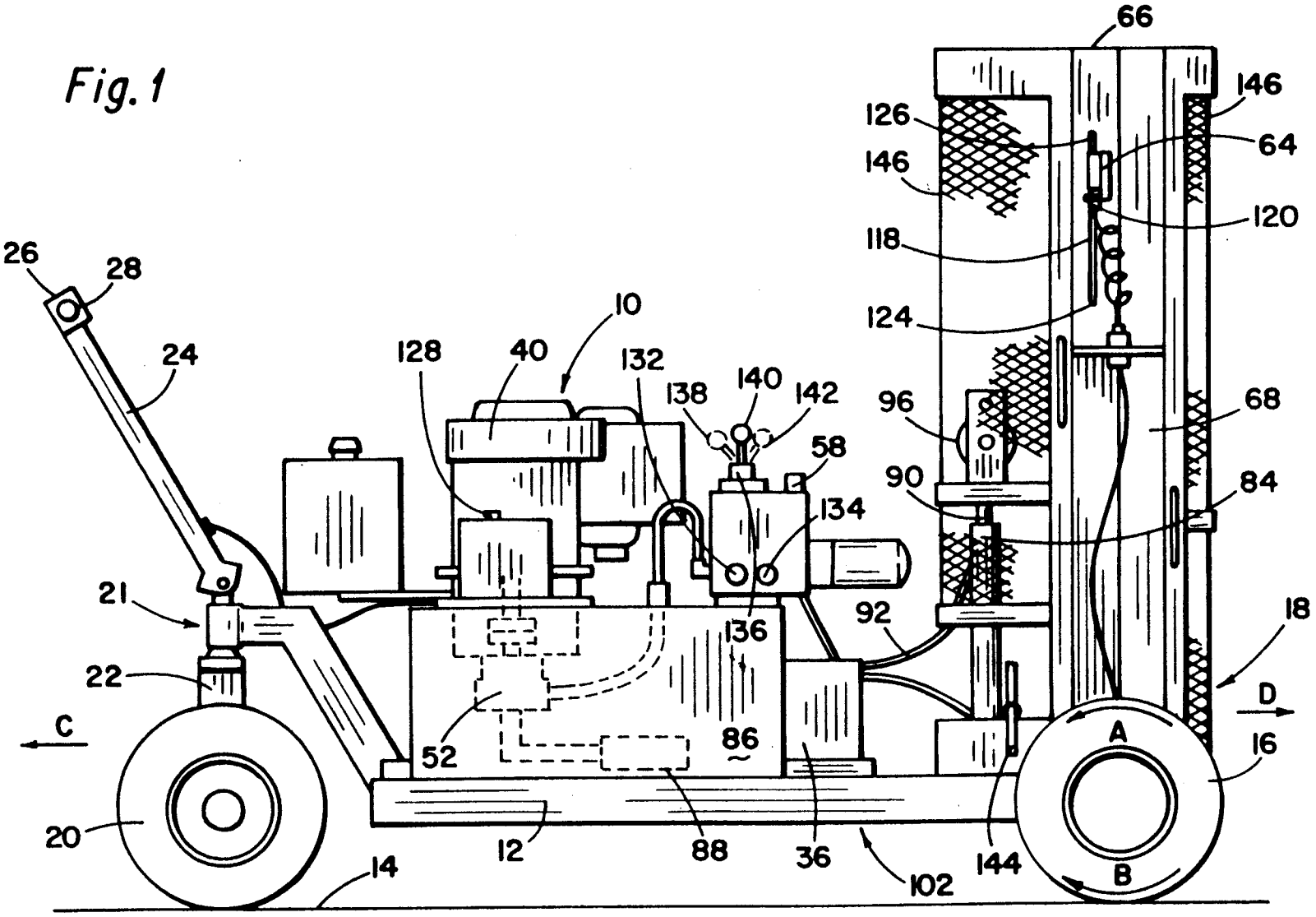
FIG. 1 is a right side elevation of a hydraulic hammer constructed according to a preferred embodiment of the present invention.
Figure 2:
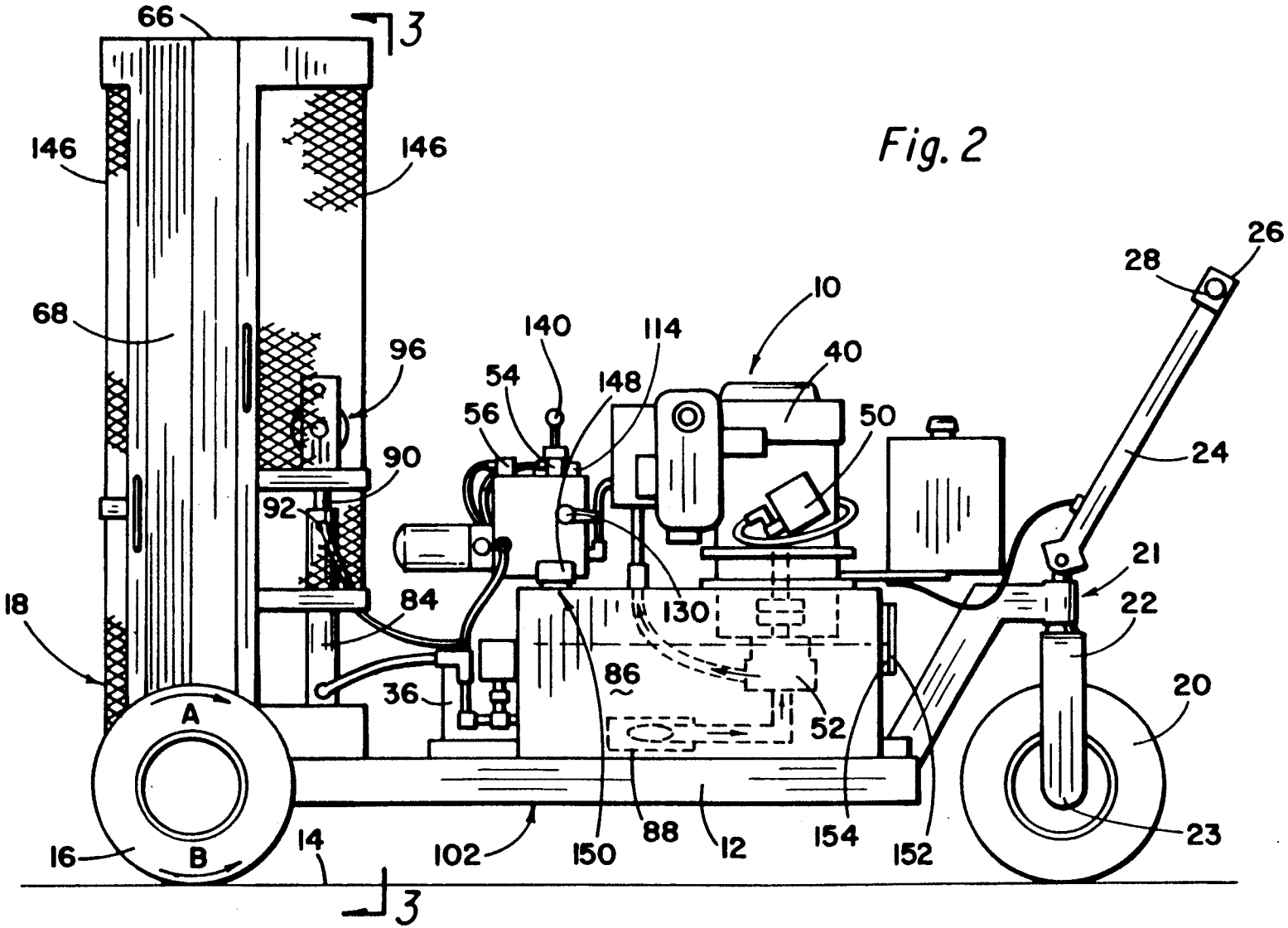
FIG. 2 is a left side elevation of the hydraulic hammer.

Referring now to the drawings and initially to FIGS. 1 and 2, there is illustrated a hydraulic hammer 10 constructed according to a preferred embodiment of the present invention. The hydraulic hammer 10 mounts on a frame 12 which is held away the supporting surface 14 by means of a pair of drive wheels 16 mounted on either side of the hydraulic hammer 10 at a rear end 18 of the hydraulic hammer 10 and by a single steering wheel 20 mounted on a vertical leg 22 provided on a front end 21 of the hydraulic hammer 10. The leg 22 movably attaches to the frame 12 and extends downward from the frame 12 on one side of the steering wheel 20, with the steering wheel 20 mounted on a lower end 23 of the leg 22. The steering wheel 20 can be turned by means of a handle 24 which pivotally attaches to the leg 22. The handle 24 is provided with a handle control panel 26 mounted between outwardly extending handle bars 28 which are gripped by an operator (not shown) when operating the hydraulic hammer 10.

Figure 10:
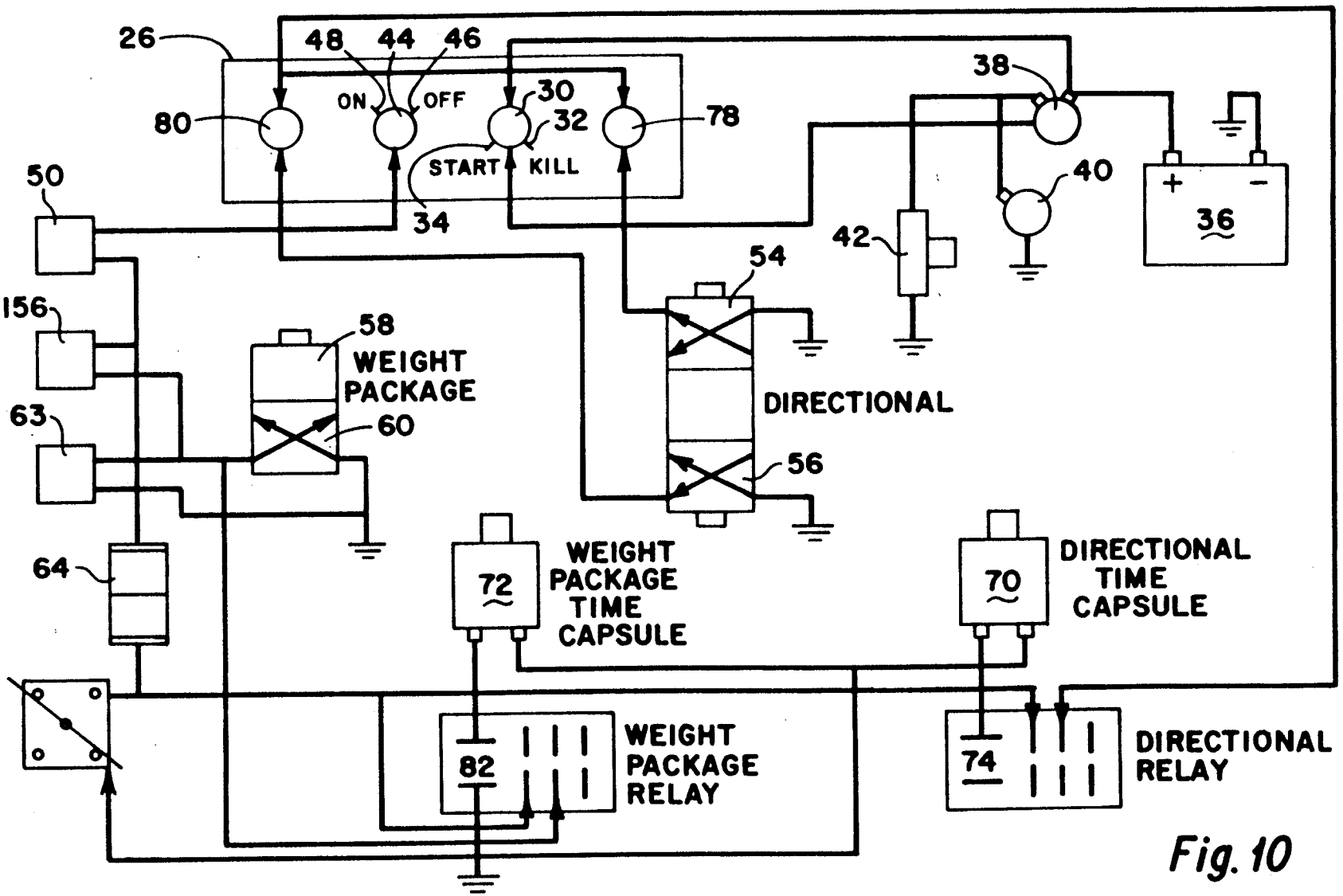
FIG. 10 is a diagram of the electrical controls of the hydraulic hammer.

Referring now also to FIG. 10, in order to operate the hydraulic hammer 10, a key start switch 30 provided on the handle control panel 26 is turned from a "kill" position 32 to a "start" position 34 which electrically connects a battery 36 to a starter solenoid 38 which engages and starts a starter motor 40. The starter motor 40 is provided with a regulator 42 which serves to keep the battery 36 charged.

Next, a hydraulic switch 44 provided on the handle control panel 26 is turned from an "off" position 46 to an "on" position 48 which electrically activates an oil sending unit 50, allowing oil pressure from the starter motor 40 to close an electrical circuit which operates a hydraulic pump 52, shown in outline in FIGS. 1 and 2, for supplying hydraulic fluid (not illustrated) for the hydraulic hammer 10. The hydraulic pump 52 hydraulically operates forward and reverse drive solenoids 54 and 56 designed to control forward and reverse rotation of the rotatable drive wheels 16 and also hydraulically operates a cylinder solenoid 58 and a dump valve solenoid 60 which control, respectively, lifting of weights 62, shown in FIGS. 3 and 4, and release of the weights 62 via a dump valve 63 after the weights 62 have been lifted sufficiently to engage and trip a limit switch 64, shown in FIG. 1. Although separate cylinder and dump valve solenoids 58 and 60 may be employed, FIG. 10 illustrates a single solenoid which serves as both the cylinder and dump valve solenoids 58 and 60.

The limit switch 64 is located on an upper end 66 of one of a pair of vertical supports 68. The vertical supports 68 are mounted vertically to the frame 12 at the rear end 18 of the hydraulic hammer 10 with one on either side thereof. Tripping the limit switch 64 simultaneously removes power from two delay timers 70 and 72, generally referred to as a directional time capsule 70 and a weight package time capsule 72.

The directional time capsule 70 is electrically connected in series to a directional relay 74. The directional relay 74 supplies power to activate the forward or reverse drive solenoids 54 and 56 which supply hydraulic fluid (not illustrated) to a pair of hydraulic drive motors 76, with one hydraulic drive motor 76 being attached to each of the drive wheels 16. Power is supplied from the directional relay 74 to the forward and reverse drive solenoids 54 and 56 via parallel circuits having a normally open forward control button 78 and a normally open reverse control button 80 connected in series respectively between the directional relay 74 and the forward drive solenoid 54 and between the directional relay 74 and the reverse drive solenoid 56. The forward and reverse control buttons 78 and 80 are provided on the handle control panel 26 for ease of access to the operator (not shown). Depending on whether the forward control button 78 or the reverse control button 80 is depressed by the operator (not shown), the forward or reverse drive solenoids 54 or 56 are activated, thus causing the drive wheels 16 to rotate in a forward rotation, as indicated in FIG. 1 by arrow "A" or in a reverse rotation, as indicated in FIG. 1 by arrow "B".

Forward rotation "A" of the drive wheels 16 causes the hydraulic hammer 10 to move in a forward direction, as indicated in FIG. 1 by arrow "C". Whereas, reverse rotation "B" of the drive wheels 16 causes the hydraulic hammer 10 to move in a reverse direction, as indicated in FIG. 1 by arrow "D". If neither the forward control button 78 nor the reverse control button 80 is depressed, the drive wheels 16 will not rotate.

The weight package time capsule 72 is electrically connected in series to a weight package relay 82 which supplies power to activate the dump valve solenoid 60 and the cylinder solenoid 58. When power is removed from the dump valve solenoid 60, hydraulic fluid (not illustrated) located in a weight lifting cylinder 84, shown in FIG. 1, is permitted to rapidly flow from the weight lifting cylinder 84 back to a hydraulic reservoir 86 provided on the hydraulic hammer 10 below the starter motor 40.

When power is supplied to the cylinder solenoid 58, hydraulic fluid (not illustrated) in the hydraulic reservoir 86 is pumped by the hydraulic pump 52 through a filter 88 located within the hydraulic reservoir 86 via a series of hydraulic lines to the weight lifting cylinder 84. Referring again to FIGS. 3 and 4, the weight lifting cylinder 84 attaches to the frame 12 and is oriented vertically upward so that as hydraulic fluid (not illustrated) enters the weight lifting cylinder 84, a piston 90 provided within the weight lifting cylinder 84 is pushed upward. The weight lifting cylinder 84 is provided with an upper hydraulic overflow line 92, shown in FIG. 2, which allows excess hydraulic fluid (not illustrated) to return to the hydraulic reservoir 86 while maintaining the piston 90 in its upward position.

Figure 4:
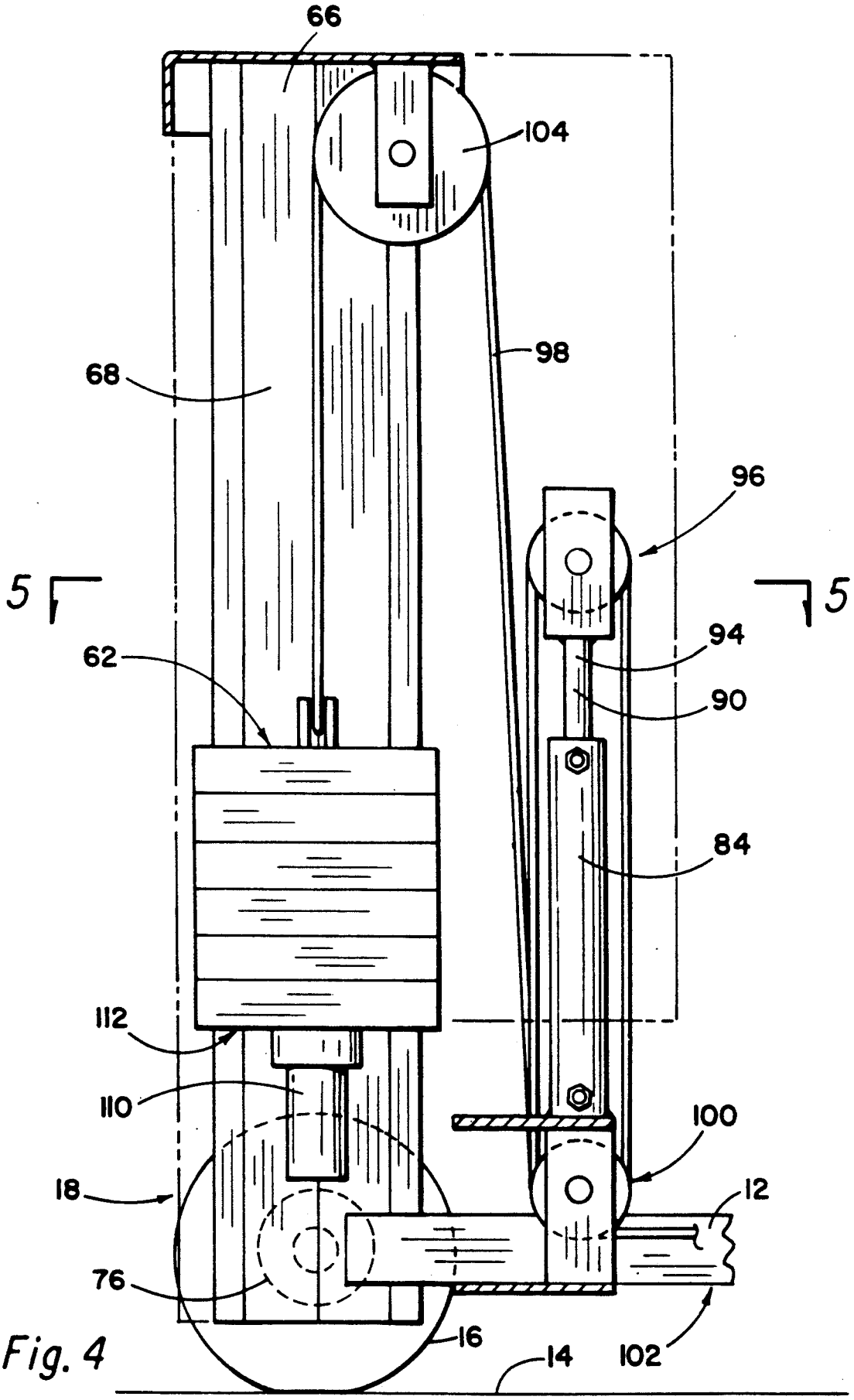
FIG. 4 is a cross sectional view taken along line 4—4 of FIG. 3.
Figure 5:
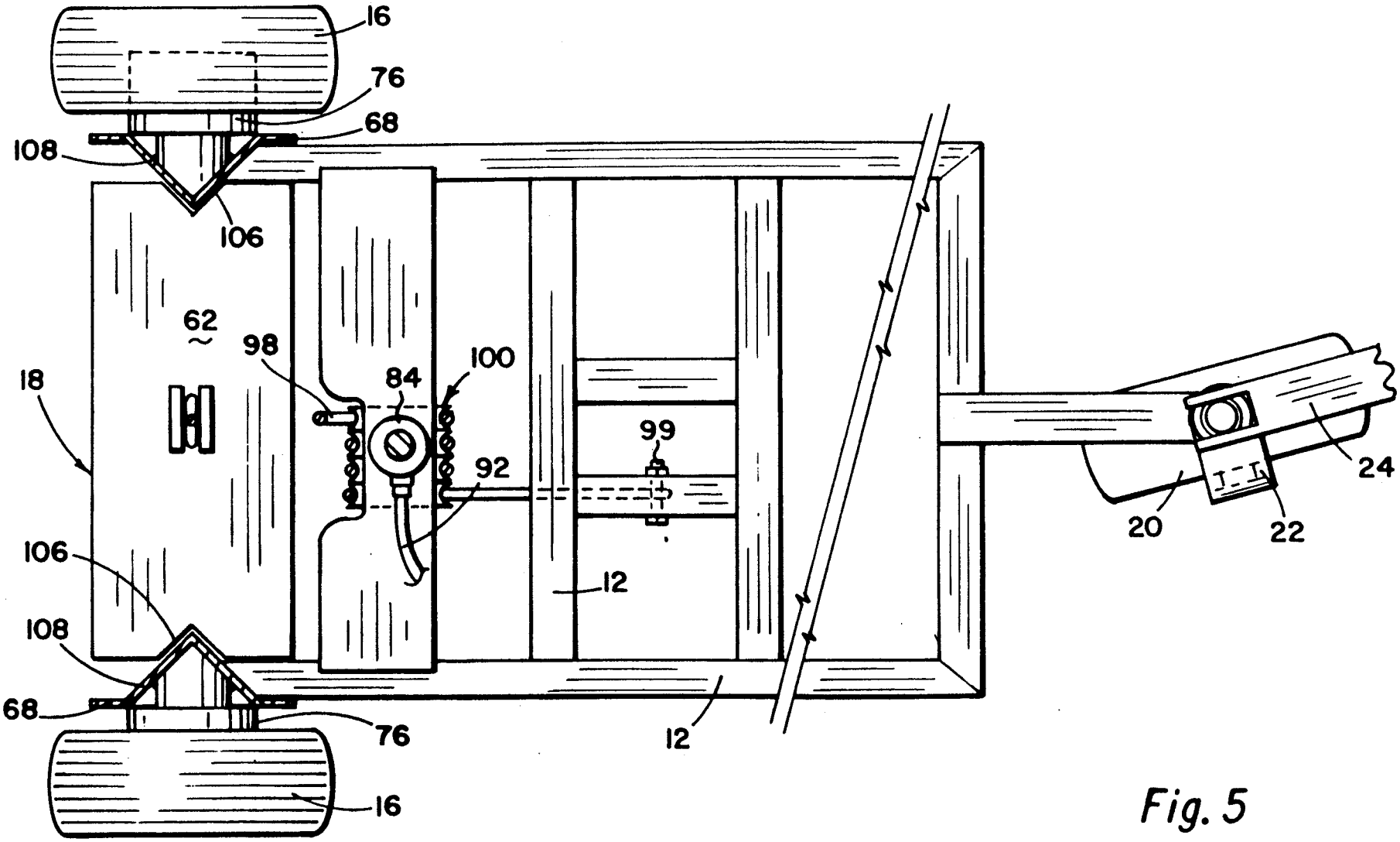
FIG. 5 is a cross sectional view taken along line 5—5 of FIG. 4 with the engine and hydraulics not illustrated.
Figure 6:
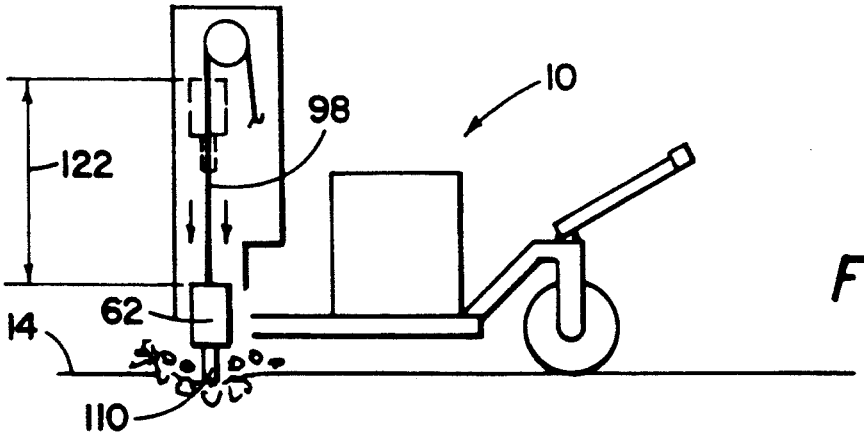
FIGS. 6-9 are schematic left side elevations of the hydraulic hammer illustrating the operating sequence by showing two cycles of impact and travel.
Figure 7:
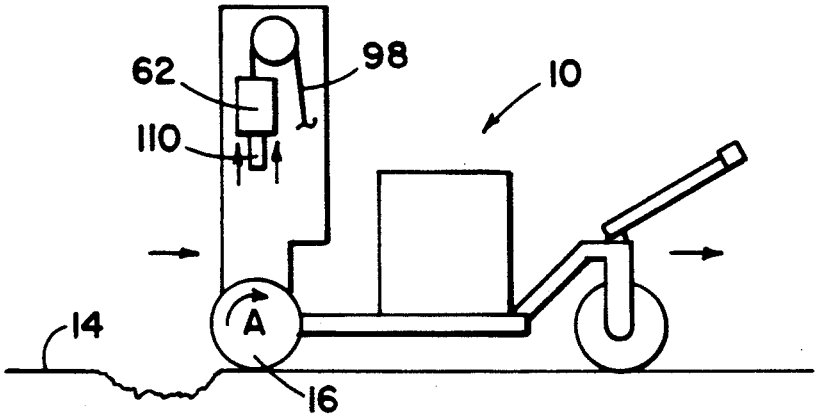
Figure 8:
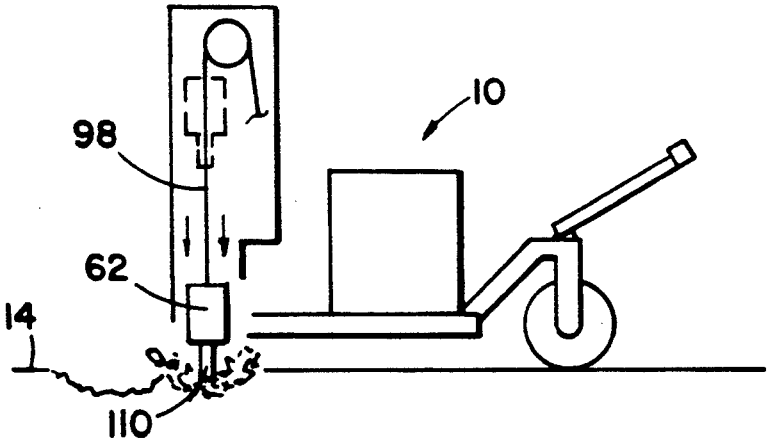

As best illustrated in FIGS. 4 and 5, an upper end 94 of the piston 90 is provided with a first set of sheaves 96. A cable 98 travels around and back and forth between the first set of sheaves 96 and a second set of sheaves 100 provided on the frame 12 of the hydraulic hammer 10 below the weight lifting cylinder 84. One end of the cable 98 attaches by means of a bolt 99 or other suitable means (not illustrated) to a lower face 102 of the frame 12 slightly forward of the second set of sheaves 100 and an opposite end of the cable 98 extends over a lifting sheave 104, located between the upper ends 66 of the vertical supports 68, before travelling downward and attaching to the weights 62 which are located at the rear end 18 of the hydraulic hammer 10. The weights 62 are attached together so they are lifted and so that they fall as a unit.

Figure 3:
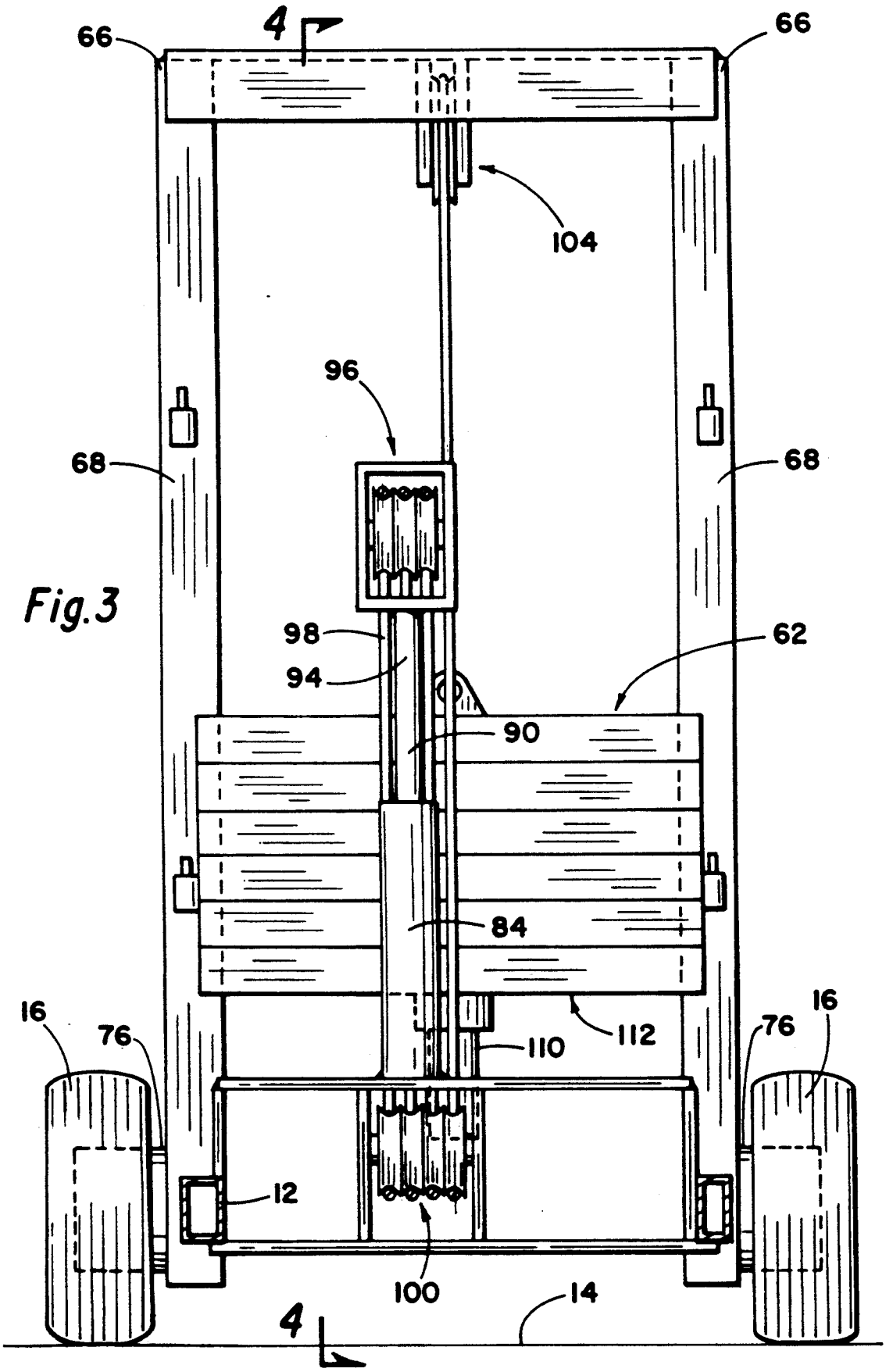
FIG. 3 is a cross sectional view taken along line 3—3 of FIG. 2 with the cage removed.

Referring now to FIGS. 3 and 5, the weights 62 are provided with side indentations 106 on either side of the weights 62. The side indentations 106, movable, extend around vertical tracks 108 provided on an inwardly facing side of each of the vertical supports 68. The purpose of the side indentations 106 and the vertical tracks 108 is to hold the weights 62 in vertical alignment as they are lifted and as they fall toward the surface 14 to be busted up by the hydraulic hammer 10. A digging tool 110 attaches to the weights 62 at a bottom side 112 of the weights 62. The first and second set of sheaves 96 and 100 and the lifting sheave 104 are located so they provide sufficient mechanical advantage to lift the weights 62 and the attached digging tool 110 when the piston 90 of the weight lifting cylinder 84 moves upward.

The weights 62 continue to move upward until they encounter the limit switch 64. The weights 62 trip the limit switch 64 by engaging and moving upward against a trigger (not illustrated) provided on the limit switch 64.

In normal operation, the operator (not shown) will be depressing either the forward control button 78 or the reverse control button 80. Therefore, when the limit switch 64 is tripped by the weights 62, the appropriate drive solenoid, either the forward or the reverse drive solenoid 54 or 56 depending on whether the forward or reverse control button 78 or 80 is pressed, will stop hydraulic fluid (not illustrated) from flowing to the hydraulic drive motors 76, thus momentarily locking the drive wheels 16 and preventing the hydraulic hammer 10 from moving either in the forward direction "C" or in the reverse direction "D".

The dump valve solenoid 60 opens simultaneously with locking of the drive wheels, causing hydraulic fluid (not illustrated) to quickly flow out of the weight lifting cylinder 84 and, thus, allowing the weights 62 and attached digging tool 110 to fall. The weights 62 and the digging tool 110 free fall by gravity until the digging tool 110, under the force of the falling weights 62, impacts the surface 14, thus breaking up the surface 14.

The directional time capsule 70 and the weight package time capsule 72 are synchronized so that the directional time capsule 70 reconnects power in order to open either the forward or reverse drive solenoid 54 or 56 simultaneously with the reconnection of power by the weight package time capsule 72 in order to close the dump valve solenoid 60 and open the cylinder solenoid 58. Thus, the hydraulic hammer 10 simultaneously resumes travelling in either the forward or reverse direction, "C" or "D", and begins to lift the weights 62. As illustrated in FIGS. 6–9, this sequence of impact and travel cycles is repeated multiple times until the surface 14 is sufficiently broken up to enable dirt moving equipment (not shown) to loosen and remove it.

Figure 9:
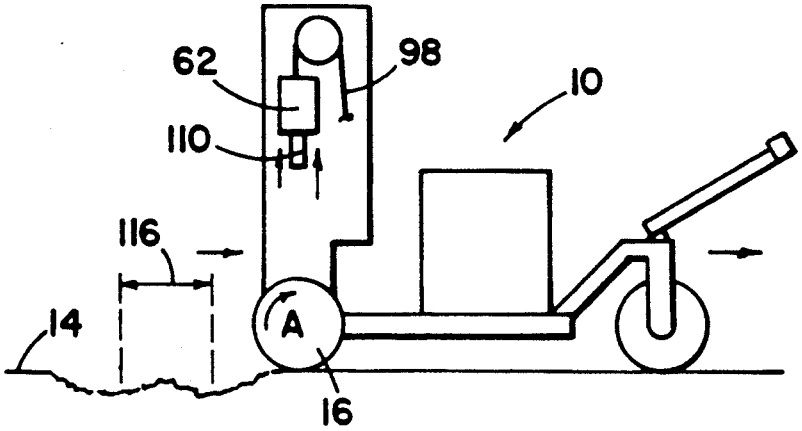

Certain surfaces 14 are more difficult to break up. Therefore, the hydraulic hammer 10 is provided with a ground speed adjustment valve 114, shown in FIG. 2, which allows the operator (not shown) to regulate flow of hydraulic fluids (not illustrated) to the hydraulic drive motors 76 to either speed up or slow down rotation of the drive wheels 16 and, thus, increasing or decreasing a distance 116, as illustrated in FIG. 9, travelled by the hydraulic hammer 10 along the surface 14 between impacts of the digging tool 110.

Also, as shown in FIG. 1, the limit switch 64 is movably attached to a slot 118 provided in the upper end 66 of one of the vertical supports 68. The limit switch 64 attaches to the slot 118 by means of a spring loaded attachment 120, which allows the limit switch 64 to be quickly relocated upward or downward along the slot 118. The limit switch 64 is relocated upward or downward in the slot 118 in order to increase or decrease a height 122, shown in FIG. 6, the weights 62 are lifted above the surface 14 before they trip the limit switch 64.

Normally, the limit switch 64 is positioned at a lower end 124 of the slot 118 in order to bust up surface 14, such as concrete, of approximately 4" depth, positioned at an upper end 126 of the slot 118 in order to bust up surface 14 of approximately 12" depth, and located mid-way between the lower and upper ends 124 and 126 of the slot 118 in order to bust up surface 14 of approximately 8" depth. Also, the digging tool 110 can be selected to match breaking characteristics of the surface 14.

Referring now to FIGS. 1 and 2, the hydraulic hammer 10 is provided with an auxiliary switch 128 which controls an auxiliary solenoid 130. The auxiliary solenoid 130 starts and stops the flow of hydraulic fluid (not illustrated) out of an auxiliary supply port 132 provided on the hydraulic hammer 10 in order to operate other auxiliary hydraulic tools (not illustrated) which may be attached to the auxiliary supply port 132. The auxiliary hydraulic tools (not illustrated) also attach to an auxiliary return port 134 provided on the hydraulic hammer 10 as a means of returning the hydraulic fluid (not illustrated) which flowed out of the auxiliary supply port 132 back to the hydraulic hammer 10.

When the hydraulic hammer 10 is being moved or being loaded onto a trailer (not illustrated) for transport, it is desirable to disengage operation of the weights 62. This is done by a three position weight package operation switch 136, shown in FIG. 1, provided on the hydraulic hammer 10. The weight package operation switch 136 has a "slow drop" position 138, a "hold" position 140, and a "hammer" position 142. During normal operation, the weight package operation switch 136 is located in the "hammer" position 142 which allows the weights 62 to be lifted upward in conjunction with travelling movement of the hydraulic hammer 10 either in the forward direction "C" or in the reverse direction "D".

In order to hold the weights 62 stationary, i.e. stop hydraulic fluid (not illustrated) from entering the weight lifting cylinder 84 without opening the dump valve solenoid 60, the weight package operation switch 136 is placed in the "hold" position 140. The weight package operation switch 136 is placed in the "hold" position 140 whenever the hydraulic hammer 10 is to be moved only a short distance over a level surface 14. When the hydraulic hammer 10 is to be moved over rough terrain, to be moved longer distances, or to be loaded onto a trailer (not shown) for transport, it is desirable to lock the weights 62 at a position so the weights 62 are located close enough to the surface 14 so that the hydraulic hammer 10 is not top heavy, but located far enough above the surface 14 so the attached digging tool 110 does not touch the surface 14.

The weights 62 may be locked in such a position by employing the weight package operation switch 136 in conjunction with a weight locking lever 144 movably provided on one side of the frame adjacent one of the vertical supports 68. The weight locking lever 144 is counterbalanced so it normally is swung out of a path travelled by the weights 62 as they are lifted and dropped and, thus, does not normally interfere with movement of the weights 62. However, the weight locking lever 144 can be manually inserted under the weights 62 by the operator (not shown) in order to prevent the weights 62 from travelling fully downward. Obviously, the weight locking lever 144 is not designed to withstand impact of the weights 62 falling onto it. Therefore, the weights 62 must be slowly lowered onto the weight locking lever 144.

The weights 62 are lowered onto the weight locking lever 144 by first placing the weight package operation switch 136 in the "hold" position 140. Next, the weight package operation switch 136 is moved to the "hammer" position 142 and held there just long enough for the weights 62 to be lifted above the weight locking lever 144. The weight package operation switch 136 is then quickly moved back to the "hold" position 140 which has the effect of suspending movement of the weights 62. At this point, the weight locking lever 144 is manually swung into position under the weights 62 and the weight package operation switch 136 is moved to the "slow drop" position 138. When the weight package operation switch 136 is in the "slow drop" position 138, hydraulic fluid (not illustrated) is gradually allowed to bleed out of the weight lifting cylinder 84, thus causing the weights 62 to gradually descend until they rest on the weight locking lever 144. With the weights 62 so secured, the hydraulic hammer 10 can be safely moved or transported.

When the hydraulic hammer 10 has been moved and the weights 62 are to be released from the weight locking lever 144, the weight package operation switch 136 is simply moved to the "hammer" position 142. As the weights 62 move upward, the weight locking lever 144 moves, due to its counterbalanced construction, out from under the weights 62 so that it will not interfere with the weights 62 when they are lifted and free fall toward the surface 14.

For safety reasons a support cage 146 is attached to the vertical supports 68 and extends around the weights 62, the weight lifting cylinder 84, the cable 98 and the sheaves 96, 100 and 104.

Also, the hydraulic reservoir 86 is provided with a hydraulic reservoir cap 148 over an opening 150 provided in the hydraulic reservoir 86 for filling the hydraulic reservoir 86 with hydraulic fluid (not illustrated). Level and temperature of the hydraulic fluid (not illustrated) contained within the hydraulic reservoir 86 can be monitored respectively via a sight glass level gauge 152 and thermometer 154 provided on a side of the hydraulic reservoir 86. Finally, an hour meter 156, as illustrated in FIG. 10, can be included on the hydraulic hammer 10 in order to record operating hours.

While the invention has been described with a certain degree of particularity, it is manifest that many changes may be made in the details of construction and the arrangement of components without departing from the spirit and the scope of this disclosure. It is understood that the invention is not limited to the embodiment set forth herein for the purpose of exemplification, but is to be limited only by the scope of the attached claim or claims, including the full range of equivalency to which each element thereof is entitled.

What is claimed is:

1. A hydraulic hammer for breaking up a surface comprising:

weights movably attached to hydraulic lifting means provided on the hydraulic hammer, a digging tool attached to the weights so that the digging tool impacts the surface when the weights fall from a lifted position, a limit switch located on the hydraulic hammer so the limit switch is tripped by the weights at their lifted position, said limit switch being electrically connected to a pair of delay timers, one said delay timer being electrically connected to a weight control means and the other said delay timer being connected to a drive control means, said weight control means connected to the hydraulic lifting means in order to control lifting and falling of the weights from their lifted position, said drive control means being connected to hydraulic drive means provided on the hydraulic hammer in order to control travel of the hydraulic hammer along the surface; and said delay timers being synchronized so the hydraulic hammer travels as the weights are lifted and so the hydraulic hammer stops travelling as the weights fall.

2. A hydraulic hammer according to claim 1 wherein the lifting means comprises:

a weight lifting cylinder provided on a frame of the hydraulic hammer, said weight lifting cylinder being provided with a hydraulically movable piston, said weight lifting cylinder being hydraulically connected to the weight control means, a first set of sheaves attached to an upper end of the piston, a second set of sheaves attached to the frame, a cable having first and second ends, said cable being attached on its first end to the frame and engaging the second and first set of sheaves in back-and-forth fashion before extending over a lifting sheave provided above the weights on the hydraulic hammer, and said second end extending downward from the lifting sheave and attached to the weights so that the weights are lifted when the piston moves away from the weight lifting cylinder, and dump valve means for quickly moving the piston toward the weight lifting cylinder in order to cause the weights to fall toward the surface.

3. A hydraulic hammer according to claim 2 wherein the weight control means comprises:

a cylinder solenoid being hydraulically connected to the weight lifting cylinder in order to move the piston away from the weight lifting cylinder, and a dump valve solenoid being hydraulically connected to the dump valve means in order to move the piston toward the weight lifting cylinder.

4. A hydraulic hammer according to claim 1 wherein the drive means comprises:

drive wheels being rotatably attached one on each side of a frame of the hydraulic hammer, said drive wheels being rotated by at least one hydraulic drive motor; and each said at least one hydraulic drive motor hydraulically attached to the drive control means.

5. A hydraulic hammer according to claim 4 wherein the drive control means comprises:

a forward drive solenoid being hydraulically connected to each said at least one hydraulic motor in order to rotate the drive wheels so the hydraulic hammer moves in a forward direction, and a reverse drive solenoid being hydraulically connected to each said at least one hydraulic drive motor in order to rotate the drive wheels so the hydraulic hammer moves in a reverse direction.

6. A hydraulic hammer for breaking up a surface comprising:

weights movably provided on the hydraulic hammer, said weights being movable to a lifted position by hydraulic lifting means attached to the weights, a circuit breaking means provided on the hydraulic hammer so that the weights trip the circuit breaking means when the weights are raised to their lifted position, drive control means and weight control means being electrically connected to the circuit breaker means so that the drive control means and the weight control means are simultaneously deactivated when the circuit breaker means is tripped;

said drive control means being hydraulically connected to drive means for moving the hydraulic hammer, said weight control means being hydraulically connected to the hydraulic lifting means in order to raise the weight, a digging tool provided on the weights so that the digging tool impacts the surface when the weights fall, one delay timer being electrically connected to the circuit breaker means and to the drive control means, a second delay timer being electrically connected to the circuit breaker means and to the weight control means, and said delay timers being synchronized so they simultaneously reconnect power to the weight control means and the drive control means.

* * * * *